United States Patent [19]

Rudolph et al.

[11] 4,214,989

[45] Jul. 29, 1980

[54] APPARATUS FOR CLEANING A SCREEN DISPOSED IN A WATER CHANNEL

[75] Inventors: Siegfried Rudolph, Hanover; Josef Nöring, Burgwedel, both of Fed. Rep. of Germany

[73] Assignee: Schreiber-Klaranlagen, Dr.-Ing. Aug, Schreiber GmbH & Co. KG, Langenhagen, Fed. Rep. of Germany

[21] Appl. No.: 14,103

[22] Filed: Feb. 22, 1979

[30] Foreign Application Priority Data

Feb. 22, 1978 [DE] Fed. Rep. of Germany ..... 2807574

[51] Int. Cl.[2] ..... B01D 35/16

[52] U.S. Cl. ..... 210/159

[58] Field of Search ..... 210/154, 159, 162, 527, 210/531

[56] References Cited

U.S. PATENT DOCUMENTS

| | | | |
|---|---|---|---|
| 1,734,813 | 1/1929 | Knowles | 210/154 |
| 2,086,821 | 7/1937 | Raisch | 210/159 |
| 2,128,345 | 8/1938 | Briggs | 210/159 |
| 2,128,346 | 8/1938 | Briggs | 210/159 |
| 2,291,121 | 7/1942 | Tolman | 210/162 |
| 3,498,466 | 3/1970 | Lechter et al. | 210/527 |
| 3,868,323 | 2/1975 | Lux | 210/154 |
| 3,909,411 | 9/1975 | Anijele et al. | 210/162 |
| 4,107,040 | 8/1978 | Rudolph et al. | 210/159 |
| 4,138,334 | 2/1979 | Rummele | 210/159 |

*Primary Examiner*—Theodore A. Granger
*Attorney, Agent, or Firm*—Watson, Cole, Grindle & Watson

[57] ABSTRACT

A screen disposed in an elongated sewage channel is cleaned by the movement of a screen comb along the vertically disposed, spaced apart bars of the screen from the bottom to the top. The screen comb is pivotally attached to the end of a rake arm which is formed of a single elongated element. The opposite end of the rake arm is pivotally attached to one end of a support arm (which support arm is pivotally attached at its opposite end to a fixed supporting structure). At a point along the length of the rake arm it is pivotally attached, by way of a laterally extending pin, to a single endless chain moving along a single guide track. Thus, the rake arm is supported in cantilever fashion from the guide track. A supporting roll around the laterally extending pin at a point supported by the guide track allows the pin (as well as the rake arm) to be moved by the endless chain along the guide track. The rack arm and the guide rack are mounted behind the screen in a channel such that their cross-sectional vertical central planes are equidistant from a longitudinally vertical central plane passing through said flow channel.

15 Claims, 6 Drawing Figures

APPARATUS FOR CLEANING A SCREEN DISPOSED IN A WATER CHANNEL

BACKGROUND OF THE INVENTION

1. Field of the Invention

The present invention relates to a screen rake which is used to clean a screen disposed in a water channel such as a sewage channel, which screen rake is movable from a rest position above the water level in the channel to a position where the comb portion thereof is in engagement with the bottom of the screen, then moved such that the comb portion is moved along the vertically oriented screen bars, then along a generally horizontal path to a point above a collecting tank where the contents of the comb portion are dumped, and then moved back to the initial rest position. The invention also relates to a screen rake which is pivotable around a horizontal axis; wherein the attached comb portion is pivotable with respect to the rake arm around a horizontal axis; wherein the rake arm is swivelable by means of a driving mechanism and movable in a vertical plane; wherein the driving mechanism includes an endless chain means which is pivotally connected to the rake arm and which is driven around fixedly mounted rotatable sprocket wheels and caused to move along a guide track; wherein the end of the rake arm opposite the end to which the comb portion is attached via a pivot means having a horizontal pivot axis to one end of an elongated support means; and wherein the elongated support means is also attached via a pivot means to a fixed supporting structure, the latter pivot means having a horizontal pivot axis.

2. Summary of the Prior Art

As shown in U.S. Pat. No. 4,107,040, an apparatus of the type herein contemplated is known wherein the rake arm is fabricated as a twin-arm assembly comprising two spaced apart individual arms, and wherein a special revolving chain is provided for each of the two arms, each endless chain moving along its own respective guide track.

Apart from the high costs of such a double guidance system, due to the need for the use of transverse struts, the construction of the apparatus is quite cumbersome, especially the welding together of the various interrelated parts. In addition, it is difficult to arrange the parallel parts in precise alignment, especially the spaced apart guide tracks. Thus cants are produced which lead to vibration and/or oscillation of the rake arm during movement. As a result, the bearings, the chains and the guide tracks are placed under great stress, and this leads to abrasion of the parts and ultimately malfunctions. In addition, as a result of the vibration and/or oscillation of the twin-armed rake, and most particularly the uncontrollable lateral movements thereof, the successful engagement of the teeth of the comb means attached thereto in between the vertically oriented bars of the screen will be jeopardized, which of course defeats the operational functioning of the entire device.

It is an object of the present invention to provide an apparatus of the general type mentioned for cleaning screens located in water channels, but which apparatus is simple to assemble, will not encounter operational difficulties known heretofore, and which will not be costly to produce.

SUMMARY OF THE INVENTION

According to the present invention the rake arm is formed as a single elongated element which is mounted to be supported by, and movable along, the guide track in a cantilever fashion, such that only one vertical supporting frame need be employed for the entire apparatus.

As a result of using only a single rake arm, i.e., a rake arm having only one elongated portion, which is mounted in a cantilever fashion from a guide track, the resulting apparatus is made less costly than prior art structures since only a single guide track and only a single endless driving chain need be employed to move the rake arm in the desired fashion.

More specifically, in accordance with the present invention the use of a single rake arm is made possible by the mounting arrangement and interrelationship between the single rake arm and the single guide track upon which the rake arm is mounted. In this regard, the rake arm is mounted in a cantilever fashion with respect to the guide track, but such that it is mounted quite stably thereon. For this purpose, a connecting means will extend from the rake arm to a point on top of a supporting surface of the guide track, and the center of gravity of the connecting means will be maintained at a point supported by the guide track due to the endless chain being connected to the connecting means adjacent the end opposite to the end pivotally connected to the rake arm. A practical embodiment of this device includes a supporting roll positioned around the connecting means between the endless chain and the rake arm, the supporting roll being positioned such that its longitudinal central vertical plane is located at a point along the supporting surface of the guide track.

According to a further feature of the invention, when the apparatus of the invention is positioned behind a screen extending across a channel through which liquid such as sewage is flowing, the apparatus is located such that a vertical plane located at a central point along the cross-sectional dimensions of the rake arm will be off center from a vertical, centrally-located plane of the channel, i.e., when viewed in cross-section. At the same time, a vertical plane located at a central point along the cross-sectional dimensions of the guide track will also be off center from the vertical centrally-located plane of the channel; however, on the opposite side thereof from the noted plane of the rake arm. In the noted practical embodiment of the invention, a longitudinal central vertical plane through the supporting roll connecting the endless chain and the rake arm will coincide with the noted vertical, centrally-located plane of the channel.

It should be appreciated that the rake arm as well as the guide track may be prefabricated in a simple manner, e.g., by casting, and this simplifies the construction of the overall apparatus, especially when only a single vertical plate-like frame is utilized for support of the guide track and other elements. In other words, the guide track and various hinge bearings, etc., of the apparatus can be cast as part of, and unitary with, the plate-like frame.

The noted advantages are particularly evident whenever the pivotable, elongated support element for the end of the rake arm opposite the end to which the comb portion is attached is formed of a single element which is connected to the frame and pivoted about a horizontal axis by way of a shaft extending into a shaft bearing (which includes internal ball bearings) mounted on the frame. The connection with the shaft bearing may be accomplished by alignment screws.

The use of a single element for the rake arm (i.e., wherein the rake arm is not composed of spaced-apart elements) and the use of only a single guide track and endless chain results in a cant-free and quiet movement for the rake arm. The balanced fashion in which the rake arm is mounted in cantilevered fashion on the guide track 2 contributes towards obtaining these advantageous operational factors.

The embodiment of the invention wherein the guide track, the support arm and the rotatable (reversible) sprocket wheels are mounted on a single vertical plate-like frame also includes a drive motor, preferably a geared engine, driving the reversible sprocket wheels, and itself mounted on the frame. The motor is positioned such that its drive shaft drives one of the sprocket wheels, such that this sprocket wheel is more correctly identified as a driving wheel, and the motor is advantageously mounted on a tightening cradle, which is itself mounted on the frame. Thus, by adjusting the positioning of the motor via movement of the cradle with respect to the frame, the driving wheel can also be repositioned. Since the endless chain will be driven by and pass over the driving wheel, its tension can be suitably controlled in a simple fashion.

In order to control the pivotal position of the comb with respect to the rake arm, an elongated draw rod is attached at one end to the comb and at its other end in articulate fashion in a swivelable crank which operates with a fulcrum together with a take-up reel and a swivelable triggering lever which releases a protecting latch by running of a roll against a bracket carried by the plate-like frame. When the rake arm moves such that the comb is submerged in the water flowing in the channel, the comb will be prevented from tilting due to a weight (preferably a jutting weight) conditioned by the position of the crank by way of toggle levers. However, a guide or bracket is connected to the frame such that when the rake arm has moved to a point where the comb, containing material removed from the screen in the water channel, is adjacent and above a collecting tank (the skimming point), the protecting latch will be released such that the comb will tilt and dump its contents into the collecting tank.

Advantageously, the comb is also provided with a reinforcement means which is pivotally attached thereto such that when the comb is tilted (over the collecting tank) the reinforcement will pivot so as to force (skim) material in the comb into the collecting tank.

Finally, it is advantageous to maintain the skimming point constant during tensioning of the chain. Thus it is advantageous to have the aforementioned tensioning cradle also support the guide or bracket, together with the driving motor and the driven reversing sprocket wheel.

Further objects, advantages and features of the invention will become more apparent from a detailed review of the arrangement and construction of the constituent parts of an embodiment of the invention depicted in the accompanying drawings and discussed in the following description.

DETAILED DESCRIPTION OF THE PREFERRED EMBODIMENT

Figure 1:
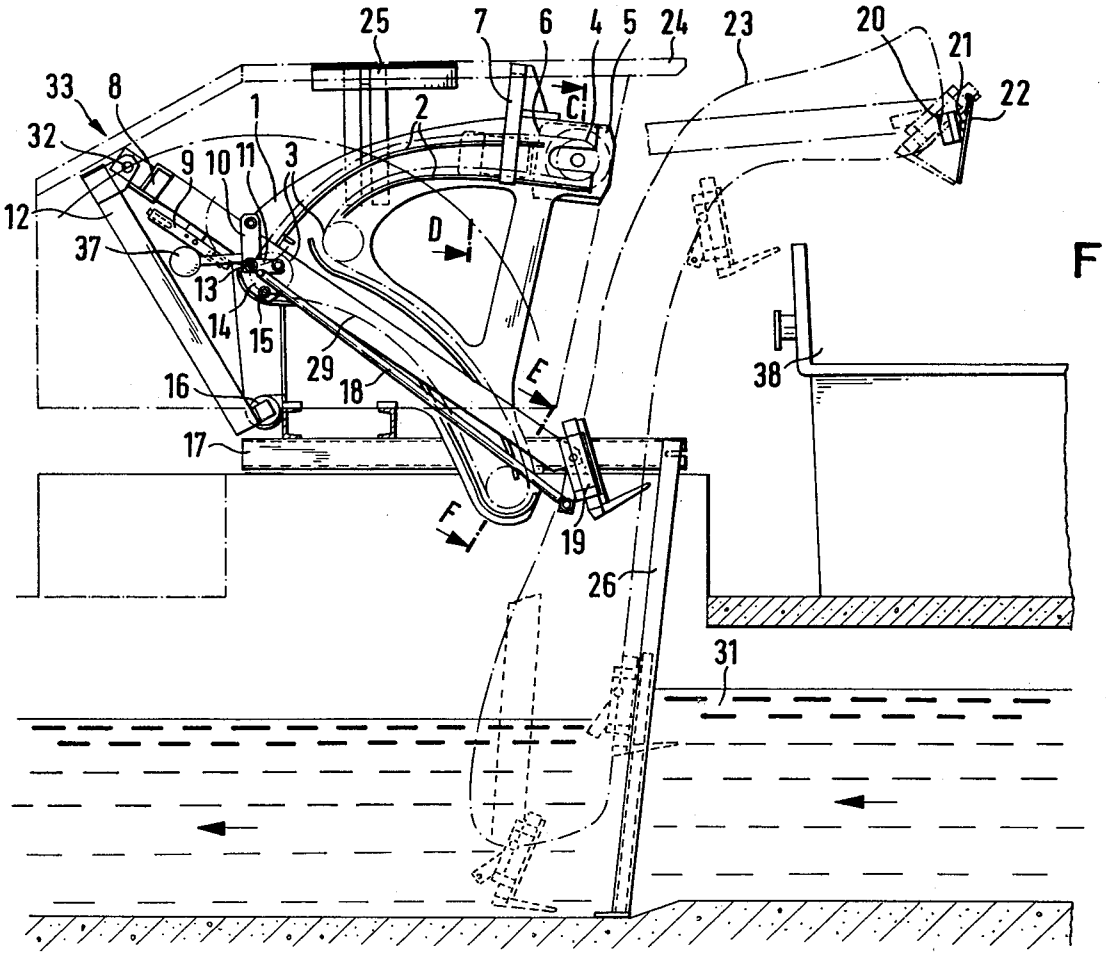
FIG. 1 shows a schematic side view of the inventive screen cleaning apparatus when mounted above the liquid level in a water channel and behind a screen, some of the various positionings of the screen comb portion of the cleaning apparatus being schematically depicted, the overall view representing a sectional view through the apparatus along line A-B as depicted in FIG. 2.
Figure 2:
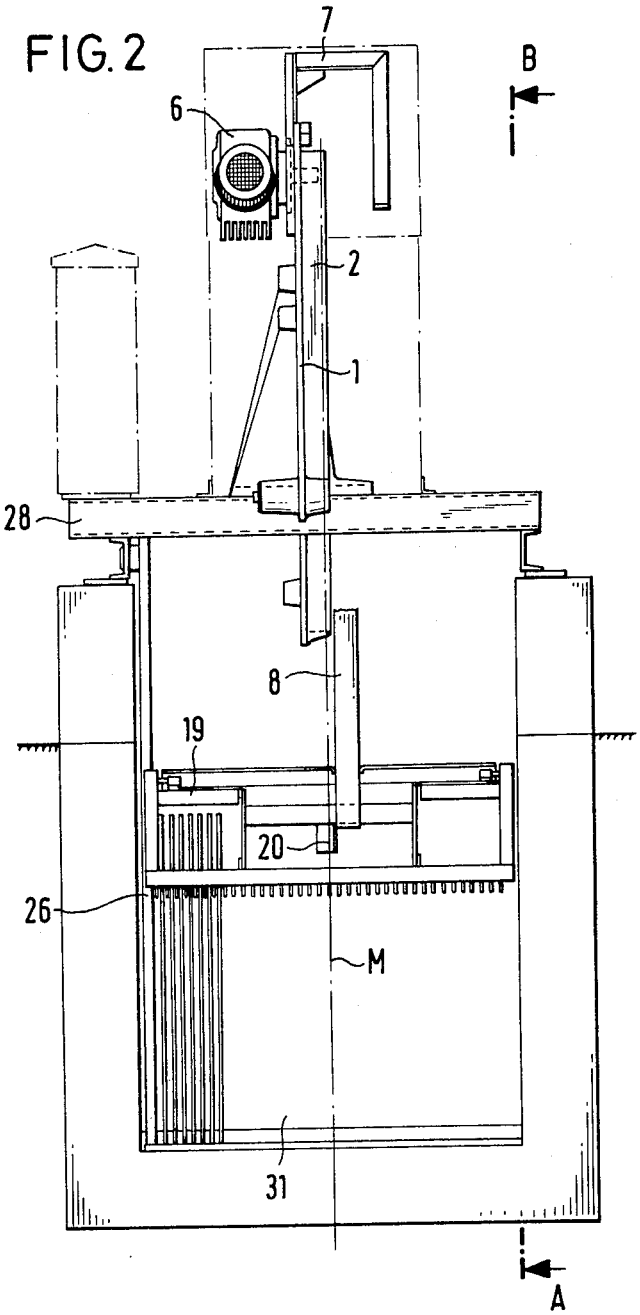
FIG. 2 shows a schematic view of the inventive screen cleaning apparatus when mounted behind a screen positioned in a water channel, the view being from behind the screen as determined by the flow of liquid through the channel, the screen comb portion of the cleaning apparatus being depicted in cleaning relationship with the screen at a time just prior to removal from contact with the screen.

According to the invention, and as can be appreciated from a review of FIGS. 1 and 2, a screen 26 which is positioned to extend across the liquid flow space in a channel 31 can be cleaned by an apparatus mounted above and behind the screen (the term "behind" meaning with respect to the flow of liquid in the channel as indicated by the arrows in FIG. 1) which includes an elongated rake arm means 8 to which is connected a screen comb means 19. As can be best seen from FIG. 1, the rake arm means 8 and the screen comb means 19 are suitably mounted and movable such that they will be locatable and movable from an intermediate or rest position (as shown in solid lines above the flowing liquid level in channel 31) to a position where the screen comb means 19 is in engagement with the vertically disposed bars of a screen 26 and then to an essentially horizontal position wherein disposal of the materials on screen comb means 19 into collecting tank 38 can take place.

The screen comb means 19 is pivotally connected to one end of rake arm means 8 such that it can rotate around a generally horizontal axis. The rake arm means 8 is itself swivelable so as to move in a predetermined way within a vertical plane by a suitable drive means, which means will be further discussed below. The end of the rake arm means opposite the end which supports screen comb means 19 is pivotally connected to one end of an elongated support arm 12 by way of a hinged bearing 33 (having a horizontal pivot axis 32), whereas the opposite end of the elongated support arm is pivotally mounted to a fixed supporting structure such that it will be pivotable around a horizontal axis 16. It can be seen that the rake arm means 8 and the support arm 12 actually form a two-armed lever.

At a point along the length of the rake arm means 8 the rake arm means is pivotally attached by suitable means (discussed below) to an endless chain means 29 which in turn is mounted to pass around four rotatable (reversible) sprocket wheels 3, 4, each sprocket wheel being mounted on a supporting structure. In between the sprocket wheels the endless chain means is caused to move along a predetermined pathway defined by a curved guide track means 2. As can be seen from FIG. 1, the defined pathway is in the form of double, generally C-shaped guideways, the lower portions being inverted in curvature from that expected, with the double, generally C-shaped guideways being spaced apart from one another. The movement of the endless chain means 29 around portions of the peripheries of sprocket wheels 3, 4, and along the guideways defined by guide track means 2 concurrently causes the point along the rake arm means connected to the endless chain means to follow the same pathway. At the same time, due to the pivotal connection 33 between the end of the rake arm means 8 and the support arm 12, as well as the fixed pivotal connection at 16 between support arm 12 and a supporting structure, the opposite end of the rake arm means 8 will move such that the center of gravity of screen comb means 19 will follow along a path as indicated by closed dash dot line 23 which coincides essentially with the path followed by the pivot axis point between the end of rake arm means 8 and the screen comb means 19.

In FIG. 1 the endless chain means 29, which can in fact take many alternative forms, is indicated by a dash dot line; however, this is intended to represent for the present purposes a roller chain which passes around sprocket wheels 3, 4 and along the guideway defined by means 2. As can be more clearly appreciated from a review of FIG. 3, a separated guide rail means 30 is positioned on the guide track means 2 so as to be between the endless chain means 29 and the guide track means. The rail means 30 may be formed of plastic.

Figure 3:
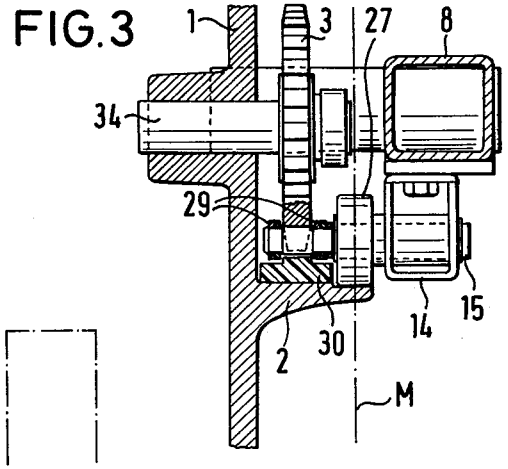
FIG. 3 shows a partial sectional view of the mounting of one of the rotating sprocket wheels and the connection of the chain with the rake arm as viewed along line E-F in FIG. 1.

The channel 31 through which the liquid to be cleaned flows will have a vertical central plane, when viewed in cross section, as indicated by dash dot line M in FIGS. 2 and 3, and the guide track means 2 will be mounted thereabove to be slightly off center with respect thereto, whereas the rake arm means 8, which is mounted via endless chain means 29 to move adjacent thereto and be supported thereby, will be positioned slightly off center on the opposite side of line M. Thus, the central plane M will be essentially equidistant from centrally located vertical planes defined by guide track means 2 and rake arm means 8, i.e., when viewed as shown in FIG. 2 in cross section. Obviously, then, the longitudinal vertical central planes through guide track means 2 and rake arm means 8 do not coincide.

The rake arm means 8 is attached to the endless chain means 29 as follows: At the appropriate point along the length of rake arm means 8 is attached a bearing block 14, and laterally mounted through block 14 is a pin 15 that is connected to the endless chain means via passage through a rotatable supporting roll 27 (see FIG. 3) which is itself mounted to roll along guide track means 2. The block 14 is pivotable with respect to pin 15. Since the pin extends beyond the guide track means 2, the rake arm means 8 is in effect supported in cantilever fashion with respect thereto.

As seen in FIG. 3, the supporting roll 27 will be positioned on guide track means 2 such that its vertical central plane, when viewed in cross section, will coincide with vertical central plane M of the channel 31, and will be equidistant from vertical central planes through guide track means 2 and rake arm means 8, i.e., when viewed in cross section. The supporting roll 27 is located in this position due to the placement of guide rail 30 on means 2. As can be seen from a review of FIG. 2, the screen comb means 19 is connected to the end of rake arm means 8 such that the connecting point is off center with respect to a vertical line of symmetry taken along a cross-sectional view of the screen comb means 10, but such that the screen comb means 19 is symmetrically positioned with respect to central plane M of channel 31.

As noted previously, one end of elongated support bar 12 is pivotally mounted at 16 to a supporting structure, and this supporting structure may take the form of spaced apart frame plates, or, as depicted in the present drawings, may take the form of a single plate-like frame 1, which frame will not only support the appropriate end of support arm 12, but will also support the sprocket wheels 3, 4, (via support shafts 34, 35) and the guide track means 2 (see FIG. 2). The plate-like frame 1 will be mounted so as to be at a distance from central vertical plane M of channel 31, and both guide track means 2 and sprocket wheels 3, 4 will be mounted on the same side thereof which faces towards central vertical plane M. The frame 1 is itself mounted on a supporting yoke formed by spaced apart longitudinal carriers 17 and spaced apart transverse carriers 28, the terms longitudinal and transverse referring to the elongated direction of channel 31.

Figure 4:
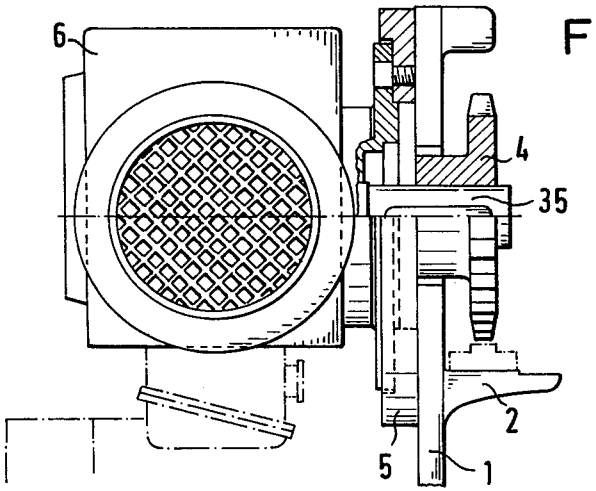
FIG. 4 shows a schematic, partial sectional view of the cleaning apparatus as viewed along line C-D in FIG. 1.

The endless chain means 29 is driven in only one direction by a drive means 6, which drive means may take the form of a geared engine. The drive means 6 is fixedly mounted on frame 1 by means of a tension cradle 5 which is itself mounted on the plate-like frame 1, preferably at the upper turning point of the chain (see FIG. 1). This placement allows for better accessibility to the drive means 6. A drive shaft 35 (see FIG. 4) extending from the drive means 6 is connected to the upper sprocket wheel 4 to thus make it a driving sprocket wheel for the endless chain means 29. The tension cradle 5 allows for an appropriate (generally horizontal as shown in FIG. 1) movement of drive means 6, and thus both drive shaft 35 and driving upper sprocket wheel 4, such that the tension in endless chain means 29 can be suitably adjusted. In addition, such adjustment can control the point at which the screen comb means 19 will discharge material into collecting tank 38, i.e., by adjusting the relative positioning of the rake arm means 8 and the overrunning bracket 7 (discussed below) when the rake arm means is caused to approach driving sprocket wheel 4.

Figure 5:
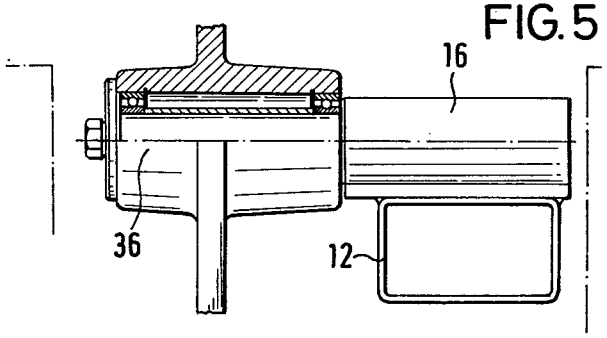
FIG. 5 shows a schematic, partial sectional view of the pivotal mounting structure for the end of the support arm opposite the end attached to the rake arm of the apparatus.
Figure 6:
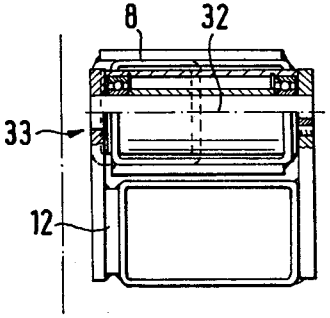
FIG. 6 shows a schematic, partial sectional view of the pivotal connecting structure between the rake arm of the apparatus and the support arm.

The support arm is pivotally mounted to a rearward, lower portion of the plate-like frame 1 via a shaft 16 which is mounted in a shaft bearing 36 (see FIG. 5). The shaft bearing 36 may be in the form of a ball bearing mount. As shown in FIG. 6, the rake arm means 8 and the support arm 12 are pivotally interconnected with the maximum possible articulation by use of two ball bearings.

The pivotal orientation of the screen comb means 19 with respect to rake arm means 8 is controlled by an articulated draw rod 18 which at one end is pivotally connected to the screen comb means 19 and at the other end is connected to a swivelable crank 10 having an attached (projecting) weight 37. The bearing (or fulcrum) connection between the draw rod 18 and the crank 10 includes a take-up reel 13 and also a swivelable releasing lever 11. The arrangement of these levers and weights is such that for every positioning of the rake arm means, the desired orientation of the screen comb means will be achieved, i.e., during the course of movement of the rake arm means such that the screen comb means will be positioned in the stream of liquid flowing through channel 31, the screen comb means will be prevented from pivoting with respect to the rake arm means due to the weight 37 of the swivelable crank 10 providing a large retaining force in opposition to the weight of the screen comb means 19 acting thereagainst, i.e., as a result of weight 37 acting along the long lever arm represented by draw rod 18 and the weight of the screen comb means 19 acting along the relatively short lever arm represented by the distance between its center of gravity and the point where the draw rod 18 is connected thereto.

During the process of combing out the screen 26, the screen comb means 19 is moved, and at the same time the positioning of draw rod 18 is controlled, such that when the screen comb means 19 has completed its cleaning operation and has left contact with the screen 26 (the bars of the screen 26 guiding the upward movement of the screen comb means), the screen comb means will be prevented from pivoting (tilting). This results because the lower edge of crank 10 will abut against the holding surface of a securing latch 9, and this positioning of the counterweight 37, is shown in FIG. 1. This prevention of tilting of the screen comb means 19 is maintained until the rake arm means 8 has pivoted and moved along the guide track means 2 to a point where the screen comb means 19 has almost reached the skimming point which coincides with the emptying position of the screen comb means. As the rake arm means 8 is then moved further along the guide track means 2, the releasing lever 11 will contact the overrunning bracket 7 such that the releasing lever 11 will be swiveled. Due to this action, the securing latch 9 will be forced downwardly to thus free crank 10. Crank 10 will then move, together with its take-up reel 13, against the overruning bracket 7 and will pull back the draw rod 18. The rake arm means 8 will, however, continue to move, and this movement when coupled with the opposite movement of draw rod 18, will cause screen comb means 19 to pivot and dump most of its contents into collecting tank 38 by gravity. In the meantime, a reinforcement 21 of a skimming plate 22 will move up on a track 20 of the rake arm means 8 and forceably skim left over or slightly stuck material off the screen comb means 19 and into collecting tank 38.

The device as shown in the drawings is enclosed by a covering hood 24 which is supported by a support means 25. Since the apparatus as a whole may be quite compact, the hood 24 may be relatively small.

While there has been shown and described a preferred embodiment of the present invention, it should be kept in mind that alternative forms will occur to those skilled in the art which will nevertheless fall within the scope of the appended claims.

We claim:

1. An apparatus for cleaning liquids such as sewage which comprises means forming a longitudinal liquid flow channel having a rectangular cross-section;

a screen positioned across said flow channel, said screen comprising spaced-apart vertically oriented bars;

a single elongated rake arm means;

a screen comb means pivotally connected to one end of said elongated rake arm means, said screen comb means being pivotable around a horizontal axis;

an elongated support arm, one end of which is pivotally connected to the end of said elongated rake arm means opposite the end to which is attached the screen comb means, the pivotal connection therebetween having a horizontal pivot axis, and the other end of which is pivotally connected to a fixed supporting structure located on the rear side of said screen and positioned across said flow channel through which liquid such as sewage flows;

a driving mechanism for moving said rake arm means such that by directly moving said rake arm means along a pathway and as a result of constrained movement of the end of said rake arm means due to pivotal attachment with said elongated support arm, said screen comb means will engage with the bottom of said screen and move upwardly so as to remove material from between the bars thereof, said driving mechanism including a fixedly mounted curved guide track means defining said pathway, a number of fixedly mounted rotatable sprocket wheels, an endless chain means fixedly and pivotally connected at one point to said rake arm means at a point along the length thereof and mounted over a portion of each of said rotatable sprockets wheels to pass along said curved guide track means and follow said pathway, and a driving means connected to one of said rotatable sprocket wheels to cause said one sprocket wheel to rotate and cause said endless chain means to move in one direction along said guide track means;

wherein the pivotal connection between said endless chain means and said rake arm means includes a pin means which extends laterally from said endless chain means to extend beyond said guide track means on which said endless chain travels, and a single rotatable support roll mounted on said laterally extending pin means between the point where the endless chain means is connected thereto and the point where the rake arm means is connected thereto, said single rotatable support roll being mounted for contact with said guide track means such that said rake arm means is supported in cantilever fashion with respect to said guide track means, and wherein said guide track means, said pin means, and said support roll are mounted such that said support roll rotates along and in contact with said guide track means concentrically with respect to a longitudinal central plane passing through said flow channel, and wherein the cross-sectional vertical central planes defined by said guide track means and said rake arm means are essentially equidistant from the longitudinal vertical central plane passing through said flow channel.

2. The apparatus as defined in claim 1 wherein said pin means is connected at one end to said endless chain means and at the other end to fit laterally through a bearing block mounted on said rake arm means so as to be pivotable with respect thereto, and wherein a rotatable supporting roll is mounted around said pin between the end thereof connected to said endless chain means and said bearing block, said supporting roll being positioned to roll along said guide track means.

3. The apparatus as defined in claim 1 wherein said supporting structure comprises a supporting yoke which includes carrier means positioned to extend across the channel and a single vertically oriented plate-like frame attached to said supporting yoke, said other end of said elongated supporting arm being pivotally connected to said single plate-like frame so as to have a horizontal pivot axis; wherein said guide track means is attached to one side of said single plate-like frame; and wherein said sprocket wheels are connected to said single plate-like frame on the same side thereof as said guide track means by horizontally oriented shaft means.

4. The apparatus as defined in claim 3 wherein said driving means comprises a motor attached to said single plate-like frame.

5. The apparatus as defined in claim 4 wherein said motor is mounted on a tension cradle which is itself adjustably connected to said single plate-like frame.

6. The apparatus as defined in claim 5 wherein said motor is connected to drive one of said sprocket wheels so as to cause said endless chain means to move.

7. The apparatus as defined in claim 6 wherein said other end of said elongated supporting arm includes a horizontally disposed shaft which includes an end rotatable within a shaft bearing connected to said single plate-like frame.

8. The apparatus as defined in claim 7 wherein said shaft bearing comprises a ball bearing mount.

9. The apparatus as defined in claim 6 including a draw rod, one end of which is attached to said screen comb means and the other end of which is articulately connected in a swivelable crank which includes a fulcrum and carries a take-up reel as well as a swivelable releasing lever, which triggers a protecting latch by a roll running against an overrunning bracket mounted on said plate-like frame.

10. The apparatus as defined in claim 9 wherein the screen comb means is prevented from tilting by the effect of the weight of the crank, depending on the position by way of toggle levers.

11. The apparatus as defined in claim 10 wherein the crank is provided with a jutting weight.

12. The apparatus as defined in claim 10 wherein said protecting latch will prevent said draw rod from moving and tilting said screen comb means until said latch contacts said overrunning bracket.

13. The apparatus as defined in claim 12 wherein said screen comb means includes a skimming plate with a reinforcement means, and wherein said reinforcement means, upon pivotal rotation of said screen comb means, will glide along a squeezing track connected to the rake arm and forceably remove material from said screen comb means.

14. The apparatus as defined in claim 13 wherein said overrunning bracket is connected to said tension cradle, which also mounts said motor and said driven sprocket wheel, such that the point at which said screen comb means is tilted by said draw rod and said skimming plate forceably removes material from said screen comb means can be maintained once the cradle has been moved to tighten the endless chain wrapped around said driven sprocket wheel.

15. The apparatus as defined in claim 1 wherein said elongated rake arm means is connected to said screen comb means at a point off center with respect to a vertical line of symmetry located along a cross-section of said screen comb means, said screen comb means being mounted within said flow channel such that said vertical line of symmetry coincides with longitudinal vertical central plane passing through said flow channel.

* * * * *